US005957603A

United States Patent [19]

Bell

[11] Patent Number: 5,957,603

[45] Date of Patent: Sep. 28, 1999

[54] COMBINATION SUPPORT AND ERASER FOR A DRY ERASE MARKER

[76] Inventor: Charles E. Bell, 170 Vera Cruz Dr. Apt. 316, Ponte Vedra Beach, Fla. 32082

[21] Appl. No.: 08/972,577

[22] Filed: Nov. 18, 1997

[51] Int. Cl.[6] ..... B43K 25/00

[52] U.S. Cl. ..... 401/52; 401/195; 15/424

[58] Field of Search ..... 461/195, 52, 198, 461/131; 15/426, 427, 424, 428; D19/53

[56] References Cited

U.S. PATENT DOCUMENTS

| | | | |
|---|---|---|---|
| 85,961 | 1/1869 | Reckendorfer . | |
| 2,205,929 | 6/1940 | Musgrave . | |
| 2,216,696 | 1/1940 | Scharf . | |
| 5,072,483 | 12/1991 | Durand . | |
| 5,432,973 | 7/1995 | Wagner . | |
| 5,855,442 | 1/1999 | Keller | 401/52 |

*Primary Examiner*—David J. Walczak
*Attorney, Agent, or Firm*—Clifford A. Poff

[57] ABSTRACT

A support for a dry erase marker and eraser for wiping writing medium of such a marker from a writing surface includes a stopper having a load bearing end face opposite from a connector surface. The connector surface is engagable with an end of the dry erase marker which is opposite a dispenser for the wipeable marker medium. A layer of pile material is supported by the load bearing end face for wiping writing medium from the writing surface while retained and supported by the housing from a ledge forming a generally horizontal support surface protruding from a writing surface. A layer of hook material is adhered to the horizontal ledge. The layers of hook and pile material are sufficiently interconnected upon contact there between to support the dry erase marker from the ledge so that the influence of gravity acting on a dry erase marker maintains the dispenser wet with writing medium.

18 Claims, 2 Drawing Sheets

48
50
52

VII
VII
52
48
50
40
42
44
46

80
76
78

56
54
60
58

74
62

X
X
74
62
64
66
68
70
72

COMBINATION SUPPORT AND ERASER FOR A DRY ERASE MARKER

BACKGROUND OF THE INVENTION

1. Field of the Invention

This invention relates to a stopper for installation on a dry erase marker to either provide a layer of material suitable for wiping writing medium of such a marker from a writing surface or provide a layer of one of either a hook or pile material to cooperate with the other of such material for support of the marker in a manner that gravity acting on the marker will maintain the dispensing element wet with writing medium.

2. Description of the Prior Art

As shown in U.S. Pat. Nos. 85,961; 2,205,929 and 2,216,696 it is known in the art of lead pencils to provide an attachment for securing a rubber eraser to an end of the pencil which is opposite the end used for writing. In the '961 patent, a metal stem is centrally located in the eraser which is formed with a reduced diameter portion from which there protrudes a threaded end portion. The reduced diameter portion is held in a counterbore by a threaded engagement with the stem of the wood of the pencil. In the '929 and '969 patents, a metal sleeve is arranged about the outer surface of a pencil which provides a cavity in which the rubber eraser is received.

The dry erase marker use a liquid writing medium which is dispensed by a felt tip. The printing medium is volatile. A removable cap is mounted on the end of the marker containing an ink dispensing felt tip to prevent loss of marker fluid by evaporation. The cap must be removed to use the marker and the marker housings is usually provided with a cavity at the end opposite of the felt tip to receive a portion of the cap for storage. In U.S. Pat. Nos. 5,072,483 and 5,432,973 there is disclosed arrangements for providing an eraser combined with a dry erase marker. The eraser element is supported by a housing structure formed with a configuration that in regard to the '483 patent is a substitute for a cap requiring that the maker be removed from the housing structure for use. In regard to the '973 patent, the housing structure of the eraser has cavities forming support sites for dry erase markers. In both patent disclosures, the markers become physically separated from the eraser when in use.

A need exists for an eraser which can be easily installed to the end of a dry erase marker to provide instant access to the eraser during use of the marker. A need also exists to provide a support arrangement for dry erase markers which will maintain the markers in an orientation such that the marking medium will be acted upon to maintain the marking tip always wet with fluid thereby preventing the formation of a fluid impervious barrier comprised of dried marking medium.

It is an object of the present invention to provide an eraser installable at the end of a dry erase marker to provide instant access to the eraser during use of the marker or any of a variety of such markers.

It is a further object of the present invention to provide a support and if desired an eraser utilizing layers of hook and pile material one of which is adhered to a stopper and the other to a horizontal surface to support the marker so that the influence of gravity acting on the writing medium maintains a dispensing tip wet with writing medium.

BRIEF SUMMARY OF THE INVENTION

According to the present invention there is provided an ink wiper for a marker having an elongated housing containing a writing medium dispensed by a tip at one end thereof onto a writing surface, the ink wiper including a body portion having a first end for interfitting frictional retention on an end of such a marker which is opposite to the medium dispensing tip thereof and a layer of wiping material adhered to a second surface which is opposite the first end of the body portion suitable to wipe such a writing medium from such a writing surface while retained and supported by the housing of such a marker.

The invention further provides the combination of a support for a dry erase marker and eraser for wiping writing medium of such a marker from a writing surface, the combination including a stopper having a load bearing end face opposite from a connector surface, the connector surface being engagable with an end of such a dry erase marker which is opposite a dispenser for such a wipeable marker medium. A first layer of one of either a hook or pile material supported by the load bearing end face for retaining and supporting the housing of such a marker. A ledge forming a generally horizontal support surface protruding from the writing surface. A second layer of the other of either a hook or pile material is adhered to the horizontal ledge, the layers of hook and pile material being sufficiently interconnected upon contact there between to support the dry erase marker from the ledge in a manner such that the influence of gravity acting on such a dry erase marker maintains the dispenser wet with writing medium.

BRIEF DESCRIPTION OF THE DRAWINGS

These features and advantages of the present invention as well as others will be more fully understood when the following description is read in light of the accompanying drawings in which.

DETAILED DESCRIPTION OF THE INVENTION

Figure 1:
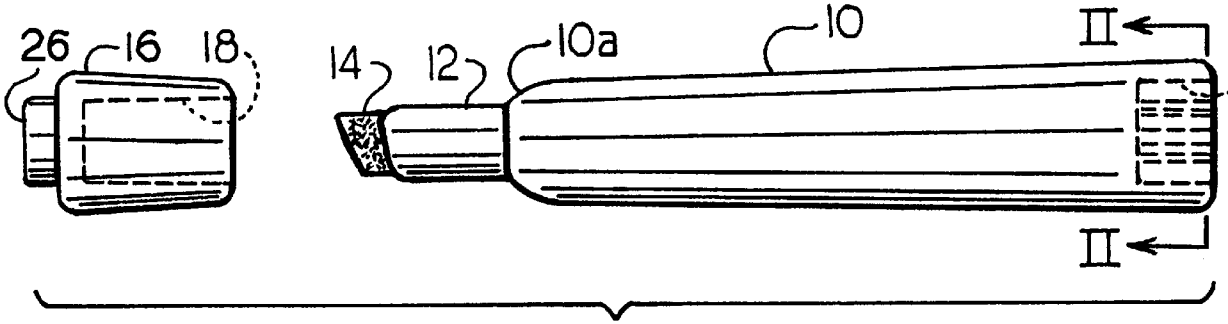
FIG. 1 is an illustration of a first per se known in the art dry erase marker showing the enclosure cap separated from the marking tip.
Figure 2:
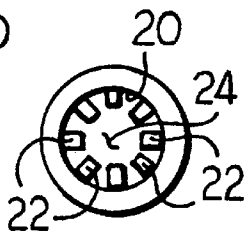
FIG. 2 is an end view of the marker taken along lines II—II of FIG. 1.

In FIGS. 1 and 2 there is illustrated a dry erase marker sold under the trademarks EXPO and STANFORD by Stanford Corporation, Dellwood, Ill. Such a marker is usually offered for sale as a set made up of different colors and for use with a white marker board as will be described in greater detail hereinafter. The marker includes a tubular housing 10 having at one end thereof a reduced diameter cylindrical neck 12 and extending from the terminal end portion is a rectangular shaped felt tip 14 which is cut on a bias. A cap 16 is formed with a first hollow cavity 18 to receive the felt tip 14 and an enlarged cylindrical cavity which forms a seal by engagement with cylindrical neck 12 when the end of the cap is fitted against a conical shoulder 10A of housing 10. As shown in FIG. 2, the end of the housing 10 which is opposite the site of tip 14 is formed with a cylindrical cavity 20 wherein radially extending ribs 22 project so that the protecting terminal edges of the ribs define a hollow support site 24 where the rib edges engage and can support a shaft segment 26 extending from the end of cap 16.

Figure 3:
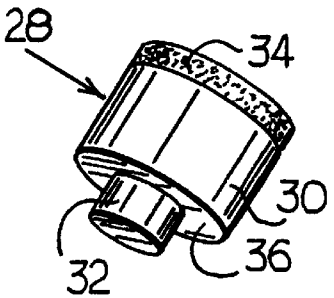
FIG. 3 is an isometric view showing a first embodiment of an eraser for a dry erase marker shown in FIGS. 1 and 2.

According to the present invention, support site 24 is used to receive and support an eraser assembly 28 as shown in FIG. 3. The eraser assembly 28 includes cylindrical shaped stopper 30 having at one end thereof a cylindrical shaped segment 32 having a diameter selected to establish a tight frictional support relation with projecting terminal edges of the ribs 22 of sufficient integrity so that when mounted at the end of the marker at cavity 20, an eraser pad 33 comprised of pile material can be effectively used to wipe markings by the marker from a white marker board. A planar shoulder 36 stabilizes the eraser by resting upon the annular end face of the housing 10 as well as the, end faces of the terminal edges of ribs 22.

Figure 5:
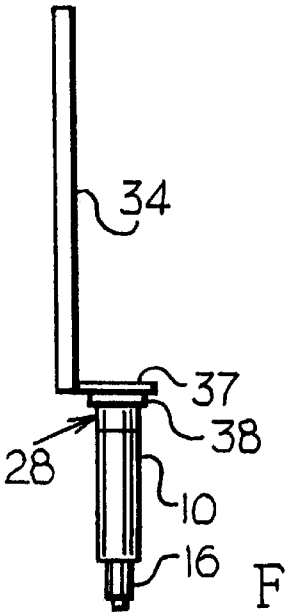
FIG. 5 is a side elevational view of the marker board shown in FIG. 4.
Figure 4:
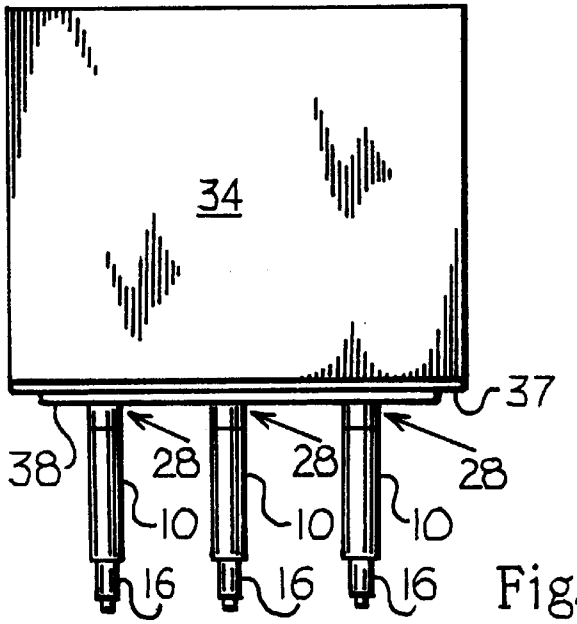
FIG. 4 is an elevation view of a marker board illustrating the use of the dry eraser marker as shown in FIG. 3 for support of the marker in a vertical orientation to maintain the marking tip wet with dispensing fluid during storage.

In FIGS. 4 and 5 there is illustrated a white marker board assembly made up of a white marker board 34 presenting a board face which has a coating suitable to receive dry erase markings and permit erasing of such markings without apparent residue. The board 34 is per se well known in the art and is of the type that includes a horizontal shelf 37 along the bottom edge of the board. According to the present invention when the eraser includes a layer of pile material there is preferably adhered to the under surface of the shelf a strip of hook material 38. The layers of hook and pile material are sufficiently interconnected upon pressing engagement between the layer of eraser 34 and the layer of hook material 38 to retain and support the marker. By this arrangement it can be seen that the tip 14 of the marker while enclosed in cap 16 is vertically orientated at the lowest most relation to the fluid containing cavity of the body of the marker whereby the effect of gravity acting on the fluid maintains the tip wet with marking fluid while in the storage location.

Figures 6, 7, 8, 9, 10, 11:
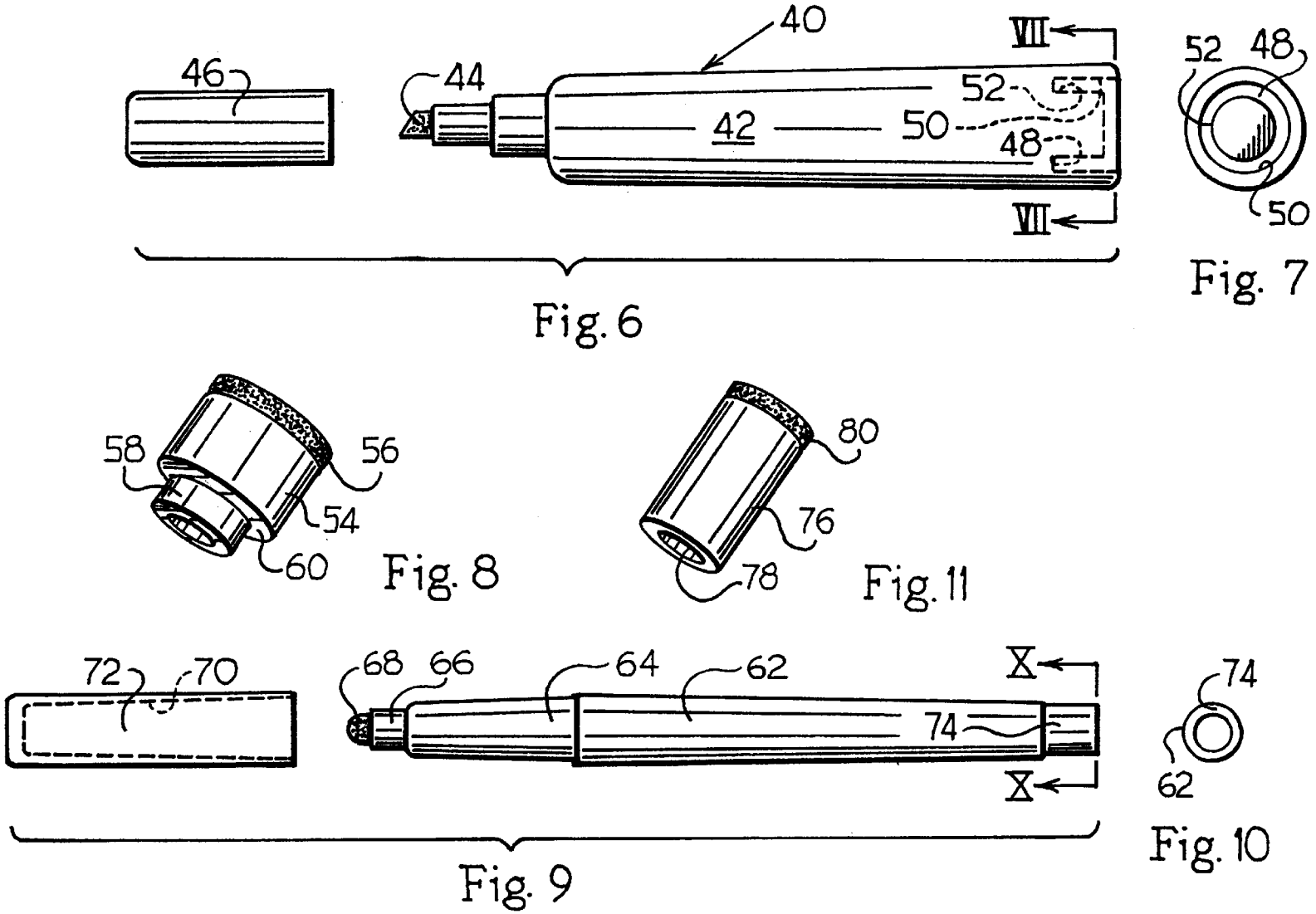
FIG. 6 is an illustration of a second per se known in the art dry eraser marker showing the enclosure cap separated from the marking tip.
FIG. 7 is an end view of the marker taken along lines VI—VI of FIG. 6.
FIG. 8 is an isometric view showing a second embodiment of an eraser for a dry erase marker shown in FIGS. 6 and 7.
FIG. 9 is an illustration of a third per se known in the art dry eraser marker showing the enclosure cap separated from the marking tip.
FIG. 10 is an end view taken along lines X—X.
FIG. 11 is an isometric view showing a third embodiment of an eraser for a dry eraser marker shown in FIGS. 9 and 10.

FIGS. 6 and 7 illustrate a dry erase marker 40 sold under the trademark MARKS-A-LOT by Avery Dennison. The marker includes housing 42 having a reduced diameter end portion where there is supported a marker tip 44 that can be enclosed by an end cap 46. In the end of the marker housing which is opposite the end tip 44, there is provided an annular recess 48 that is formed between an outer and inner annular walls 50 and 52 respectively. The eraser of the present invention for use with the marker as shown in FIGS. 6 and 7 is illustrated in FIG. 8 and includes an annular stopper 54 having an end face to which there is adhered a layer of pile material 56. The end of the stopper which is opposite the location of the pile material is provided with a protruding hollow cylindrical section 58 which is a hollow cylinder throughout the extended length thereof and is dimensioned to tightly fit in the annular cavity 48 for support of the eraser by the marker housing. When the eraser is supported by the marker a shoulder portion 60 seats against the end face of the marker housing.

FIGS. 9 and 10 illustrates a second form of a dry erase maker sold under the trademarks EXPO and STANFORD by Stanford Corporation, Dellwood, Ill. The marker includes slender housing 62 as compared with housing 42. A truncated conical portion 64 terminates at a cylindrical shoulder 66 wherein there is supported a felt tip 68 for dispensing liquid marking medium stored in the housing 62. The truncated conical portion 64 tightly fits within a cavity 70 in an end cap 72. The cavity in the end cap is sufficiently large to be received on the body 62. The terminal end of the body which is opposite the felt tip 68 is formed with a truncated conical end portion 74. As shown in FIG. 11 an eraser, according to the present invention, has a barrel shaped body portion 76 with a cylindrical cavity 78 can tightly fit on the truncated portion 74 on the marker body 62. Cavity 78 terminates at an end wall having a planar face surface which is opposite cavity 78 and to which there is adhered a layer 80 of pile material which is suitable to wipe marking medium from the dry erase marking board.

As will be understood by those skilled in the art the support arrangement for markers as shown in FIGS. 4 and 5 can be accomplished by applying hook material to the stopper and pile material under surface of the shelf without departing from the present invention.

While the present invention has been described in connection with various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. An ink wiper for a marker having an elongated housing containing a writing medium dispensed by a tip at one end thereof onto a writing surface, the ink wiper including:

a body portion having a first end including a projection that is a hollow cylinder throughout the extended length thereof sufficient for interfitting retention in a cavity in an end of such a marker which is opposite to the medium dispensing tip thereof; and a layer of wiping material adhered to a second surface which is opposite said first end of the body portion suitable to wipe such a writing medium from such a writing surface while retained and supported by the housing of such a marker.

2. The ink wiper according to claim 1 wherein the second surface of the body portion is a generally planar surface located at a second end of the body portion opposite the first end and wherein said wiping material is a layer of pile material.

3. The combination of a support for a dry erase marker and eraser for wiping writing medium of such a marker from a writing surface, said combination including:

a stopper having a load bearing end face opposite from a connector surface, said connector surface being engagable with an end of such a dry erase marker which is opposite a dispenser for such a wipeable marker medium;

a first layer of one of either a hook or pile material supported by said load bearing end face for retaining and supporting the housing of such a marker;

a ledge forming a generally horizontal support surface adapted to protude from such a writing surface; and a second layer of the other of either a hook or pile material adhered to said horizontal ledge, said layers of hook and pile material being sufficiently interconnected upon contact there between to support said dry erase marker from the ledge in a manner such that the influence of gravity acting on such a dry erase marker maintains said dispenser wet with writing medium.

4. The combination according to claim 3 wherein said load bearing face of said stopper is a generally planar surface located at a second end of the body portion opposite the connector surface.

5. The combination according to claim 3 wherein said connector surface includes a projection having an extended length sufficient for interfitting retention in a cavity in said end of such a marker.

6. The combination according to claim 5 wherein said projection has an outer surface that is circular in section.

7. The combination according to claim 6 wherein the projection is cylindrical throughout the extended length thereof.

8. The combination according to claim 6 wherein the projection is a hollow cylinder throughout the extended length thereof.

9. The ink wiper according to claim 3 wherein said connector surface of said stopper defines a cavity surrounded by an annular wall for engaging an end portion of the elongated housing for such a marker.

10. The combination of a support for a dry erase marker and eraser for wiping writing medium of such a marker from a writing surface, said combination including:

a stopper having a load bearing end face opposite from a connector surface, said connector surface being engagable with an end of such a dry erase marker which is opposite a dispenser for such a wipeable marker medium;

a layer of pile material supported by said load bearing end face for wiping writing medium from such a writing surface while retained and supported by the housing of such a marker;

a ledge forming a generally horizontal support surface adapted to protrude from such a writing surface; and a layer of hook material adhered to said horizontal ledge, said layers of hook and pile material being sufficiently interconnected upon contact there between to support said dry erase marker from the ledge in a manner such that the influence of gravity acting on such a dry erase marker maintains said dispenser wet with writing medium.

11. The combination according to claim 10 wherein said load bearing face of said stopper is a generally planar surface located at a second end of the body portion opposite the connector surface.

12. The combination according to claim 10 wherein said connector surface includes a projection having an extended length sufficient for interfitting retention in a cavity in said end of such a marker.

13. The combination according to claim 12 wherein said projection has an outer surface that is circular in section.

14. The combination according to claim 12 wherein the projection is cylindrical throughout the extended length thereof.

15. The combination according to claim 14 wherein the projection is a hollow cylinder throughout the extended length thereof.

16. The ink wiper according to claim 10 wherein said connector surface of said stopper defines a cavity surrounded by an annular wall for engaging an end portion of the elongated housing for such a marker.

17. An ink wiper for a dry erase marker including an elongated housing having a cylindrical cavity in an end of the housing in which ribs extend radially inward from an inner surface of the cylindrical cavity, said ink wiper including the combination of:

a body portion having a cylindrical projection extending from a planar shoulder at a first end and having a diameter sufficient to establish a tight frictional support relation with projecting terminal edges of such ribs in such a cylindrical cavity and stabilized by said planar shoulder when resting upon the housing of such a dry erase marker; and a layer of wiping material adhered to said body portion opposite said cylindrical projection to wipe a writing medium from a writing surface while said body portion is retained and supported by the housing of such a marker.

18. An ink wiper for a dry erase marker including an elongated housing having a truncated conical terminal end portion opposite a writing tip, said ink wiper including the combination of:

a body portion having a cylindrical cavity surrounded by an annular wall, said cylindrical cavity being open at one end and terminates at a load bearing wall having a face surface which is opposite the cavity, said cylindrical cavity having a diameter selected to establish a tight fitting relation on such a truncated conical end portion of such a marker when inserted into said cylindrical cavity of said body portion; and a layer of wiping material adhered to said load bearing surface of said body portion suitable to wipe a writing medium from a writing surface while said body portion is retained and supported by said cylindrical cavity.

* * * * *